United States Patent [19]

Ohba et al.

[11] Patent Number: 4,801,920

[45] Date of Patent: Jan. 31, 1989

[54] EL PANEL DRIVE SYSTEM

[75] Inventors: Toshihiro Ohba, Nara; Hiroshi Kinoshita, Yamatokoriyama; Yoshiharu Kanatani, Nara; Hisashi Uede, Wakayama, all of Japan

[73] Assignee: Sharp Kabushiki Kaisha, Osaka, Japan

[21] Appl. No.: 532,961

[22] Filed: Sep. 16, 1983

[30] Foreign Application Priority Data

Sep. 27, 1982 [JP] Japan ..... 57-169316

[51] Int. Cl.[4] ..... G09G 3/30

[52] U.S. Cl. ..... 340/781; 340/805; 340/811

[58] Field of Search ..... 340/781, 805, 811, 812, 340/825.81; 368/239; 315/169.3

[56] References Cited

U.S. PATENT DOCUMENTS

| | | | |
|---|---|---|---|
| 4,048,632 | 9/1977 | Spence | 340/813 |
| 4,100,540 | 7/1978 | Fujita et al. | 340/805 |
| 4,123,671 | 10/1978 | Aihara et al. | 340/811 |
| 4,168,498 | 9/1979 | Kubota et al. | 340/811 |
| 4,200,868 | 4/1980 | Lamoureux et al. | 340/713 |
| 4,255,804 | 3/1981 | Suganuma | 368/239 |
| 4,338,598 | 7/1982 | Ohba et al. . | |
| 4,456,904 | 6/1984 | Tukahara et al. | 340/781 |
| 4,479,120 | 10/1984 | Ohba et al. | 340/781 |
| 4,485,379 | 11/1984 | Kinoshita et al. | 340/781 |
| 4,593,279 | 6/1986 | Leach et al. | 340/805 |
| 4,594,589 | 6/1986 | Ohba et al. | 340/781 |

*Primary Examiner*—Gerald L. Briganoe
*Assistant Examiner*—Jeffery A. Bier
*Attorney, Agent, or Firm*—Birch, Stewart, Kolasch & Birch

[57] ABSTRACT

A drive system for a thin-film EL matrix display panel includes first and second voltage doubler circuits and a DC booster circuit. A $\frac{1}{4}V_M$ voltage, which has the $\frac{1}{4}$ voltage level of the modulation voltage, is applied to the first voltage doubler circuit of which an output voltage is applied to a modulation voltage applying circuit. The $\frac{1}{4}V_M$ voltage is further applied to the DC booster circuit which develops an output voltage having a voltage level of $\frac{1}{2}V_W$. The thus obtained $\frac{1}{2}V_W$ voltage is applied to the second voltage doubler circuit of which an output voltage is applied to a write voltage applying circuit.

10 Claims, 6 Drawing Sheets

PRIOR ART ( VOLTAGE DOUBLER -38,44- )

( DC BOOSTER -40- )

EL PANEL DRIVE SYSTEM

BACKGROUND AND SUMMARY OF THE INVENTION

The present invention relates to a drive system for driving an electroluminescent (EL) display panel and, more particularly, to a power supply system in a driver circuit of an EL display panel.

Generally, a thin-film EL matrix display panel requires three voltage levels for achieving the display. More specifically, a logic circuit generally operates with a DC voltage of 5 to 15 volts. A driver circuit requires a second DC voltage of about 30 volts in order to develop a modulation voltage. The driver circuit further requires a third DC voltage of about 185 to 210 volts in order to develop a write pulse and a refresh pulse. In the conventional drive system of the thin-film EL matrix display panel, these three kinds of voltages are supplied from a power supply circuit to a driver circuit. This complicates the drive system of the thin-film EL matrix display panel, and disturbs the integration of the logic circuit with the driving pulse generation circuit.

Accordingly, an object of the present invention is to provide a novel drive system for a thin-film EL matrix display panel.

Another object of the present invention is to provide a drive system for an EL panel, which creates a refresh/write pulse voltage within the drive system, whereby the refresh/write pulse voltage is not required to be supplied from a power supply circuit to the drive system.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, only a logic drive voltage and a $\frac{1}{4}$ $V_M$ voltage which has the $\frac{1}{4}$ level of a modulation voltage $V_M$ are supplied from a power supply circuit to a drive system. The drive system includes a first voltage doubler circuit which introduces the $\frac{1}{4}$ $V_M$ voltage and developes the modulation voltage in response to a timing signal. The drive system further includes a DC booster circuit such as a DC-DC converter for boosting the $\frac{1}{4}$ $V_M$ voltage. An output voltage of the DC booster circuit is applied to a second voltage doubler circuit which generates the write pulse voltage and the refresh pulse voltage in response to the timing signal.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
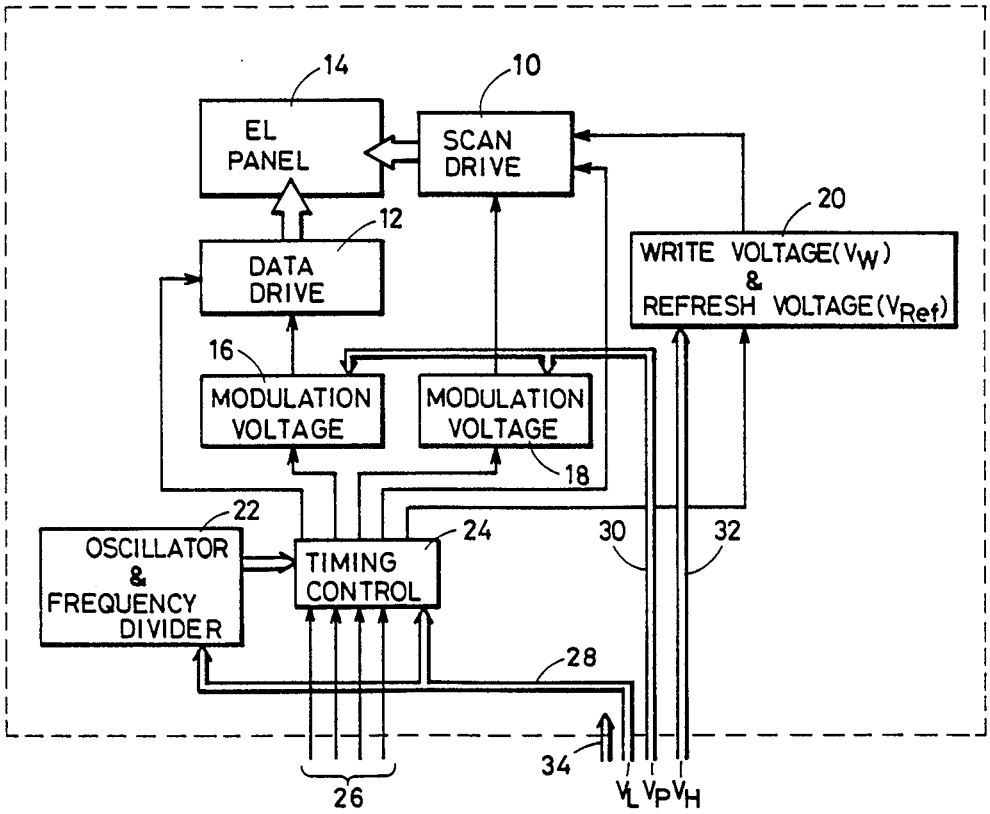
FIG.1 PRIOR ART
FIG. 1 is a block diagram of an EL panel drive system of the prior art.

FIG. 1 shows an example of an EL panel drive system of the prior art. A scanning side driver circuit 10 and a data side driver circuit 12 are connected to a thin-film EL matrix display panel 14. The scanning side driver circuit 10 includes an N-channel MOS IC and an anode-common diode array. The data side driver circuit 12 includes an N-channel MOS IC and an anode-common diode array. The EL panel drive system of the prior art further includes a data side modulation voltage applying circuit 16, a scanning side modulation voltage applying circuit 18, a write voltage ($V_W$)/refresh voltage ($V_{Ref}$) applying circuit 20, an oscillator/frequency divider 22, and a timing control circuit 24. A data signal and a synchronization signal are introduced into the drive system via a data line 26. The drive system is connected to receive a logic circuit drive voltage $V_L$ via a wiring 28, a modulation drive voltage $V_P$ via a wiring 30, and a write/refresh drive voltage $V_H$ via a wiring 32. Furthermore, the grounded line 34 is connected to the drive system.

The timing control circuit 24 develops control signals in response to an output signal developed from the oscillator/frequency divider 22, and the data signal and the synchronization signal applied thereto via the data line 26. The control signals developed from the timing control circuit 24 are applied to the scanning side driver circuit 10, the data side driver circuit 12, the data side modulation voltage applying circuit 16, the scanning side modulation voltage applying circuit 18, and the write voltage ($V_W$)/refresh voltage ($V_{Ref}$) applying circuit 20 so that a write pulse is sequentially applied to the thin-film EL matrix display panel 14 along scanning electrodes, and a refresh pulse is applied to the thin-film EL matrix display panel 14 when one-field writing is completed.

Figure 2:
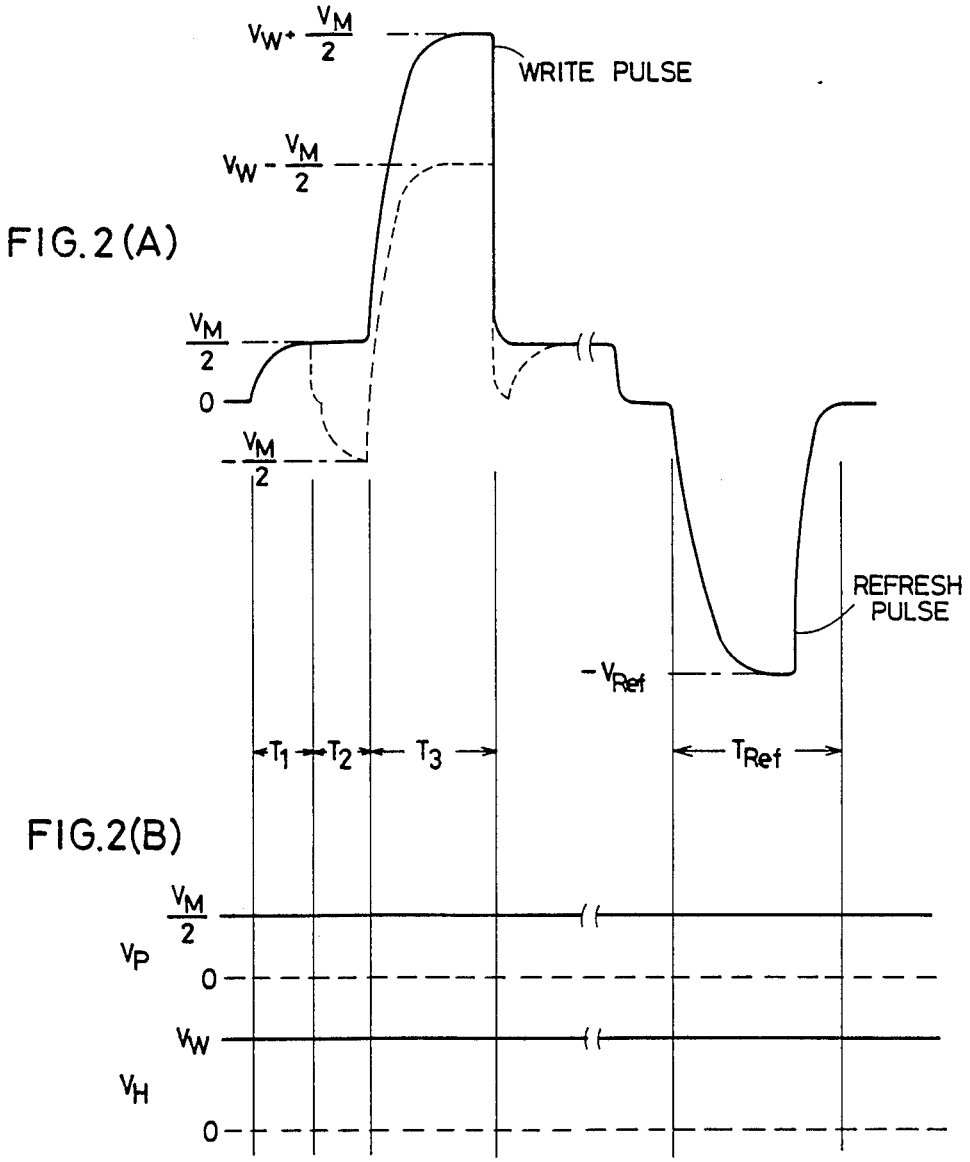
FIGS. 2(A) and 2(B) are waveform charts for explaining an operational mode of the EL panel drive system of FIG. 1.

FIG. 2(A) shows a waveform of a voltage applied to a picture point of the thin-film EL matrix display panel 14 which is driven by the drive system of FIG. 1.

$T_1$ represents a precharge period wherein a modulation voltage $\frac{1}{2}$ $V_M$ is precharged in the thin-film EL matrix display panel 14 through the use of the data side modulation voltage applying circuit 16 and the scanning side driver circuit 10. $T_2$ represents a charge/discharge period wherein, through the use of the scanning side modulation voltage applying circuit 18 and the data side driver circuit 12, the modulation voltage $\frac{1}{2}$ $V_M$ is applied to a selected picture point (emitting position), and $-\frac{1}{2}$ $V_M$ is applied to a non-selected picture point (non-emitting position). In FIG. 2(A), the solid line shows the waveform of the voltage applied to the selected picture point, and the broken line shows the waveform of the voltage applied to the non-selected picture point. $T_3$ represents a write period wherein a writing operation is conducted by the write voltage ($V_W$)/refresh voltage ($V_{Ref}$) applying circuit 20. A write pulse having an amplitude of $V_W+\frac{1}{2}V_M$ is applied to the selected picture point, and a non-write pulse having an amplitude of $V_W-\frac{1}{2}V_M$ is applied to the non-selected picture point. $T_{Ref}$ represents a refresh period for applying the refresh pulse to the entire picture points of the thin-film EL matrix display panel 14.

As shown in FIG. 2(B), the modulation drive voltage $V_P$, which is applied to the data side modulation voltage applying circuit 16 and the scanning side modulation voltage applying circuit 18, has the voltage level of the modulation voltage $\frac{1}{2}V_M$. The write/refresh drive voltage $V_H$, which is applied to the write voltage ($V_W$)/refresh voltage ($V_{Ref}$) applying circuit 20, has the voltage level of the write voltage $V_W$. Usually, the modulation voltage $\frac{1}{2}V_M$ is about 30 volts and the write voltage $V_W$ is about 185 to 210 volts.

In accordance with the present invention, the write voltage $V_W$ is not required to be supplied from a power supply circuit to the drive system of the present invention. That is, the drive system of the present invention receives, from a power supply circuit, the logic drive voltage $V_L$ and a $\frac{1}{4}V_M$ voltage which has the $\frac{1}{4}$ level of the modulation voltage $V_M$. The actual modulation voltage and the write/refresh voltage are formed in the drive system of the present invention from the $\frac{1}{4}V_M$ voltage.

Figure 3:
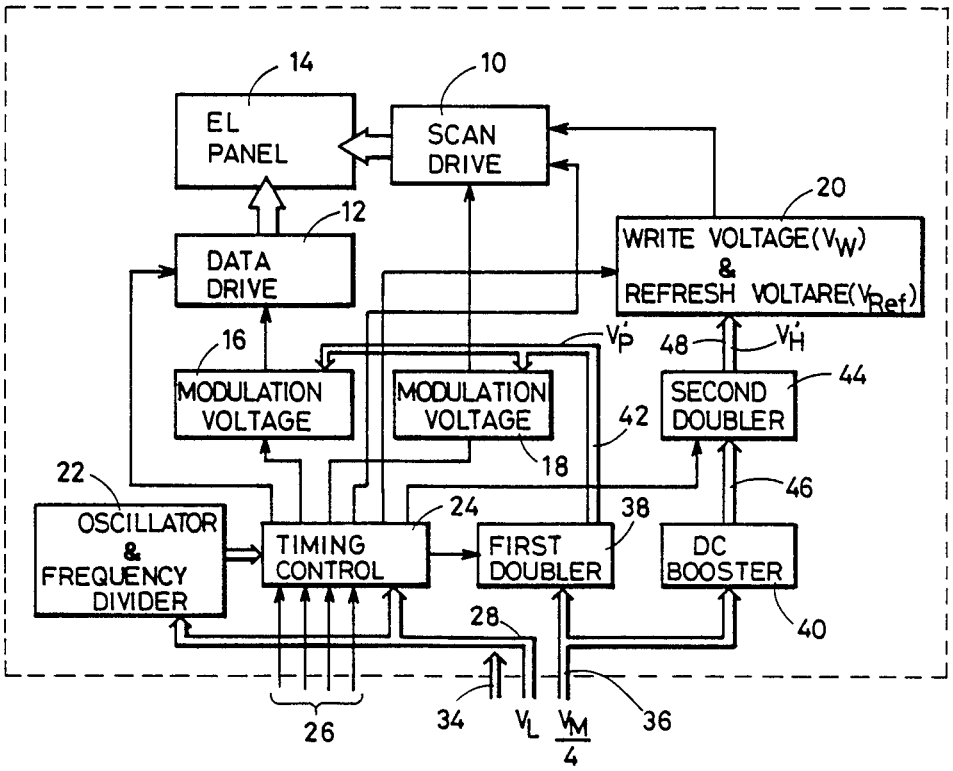
FIG. 3 is a block diagram of an embodiment of an EL panel drive system of the present invention.

FIG. 3 shows an embodiment of a thin-film EL matrix panel drive system of the present invention. Like elements corresponding to those of FIG. 1 are indicated by like numerals.

Figure 5A:
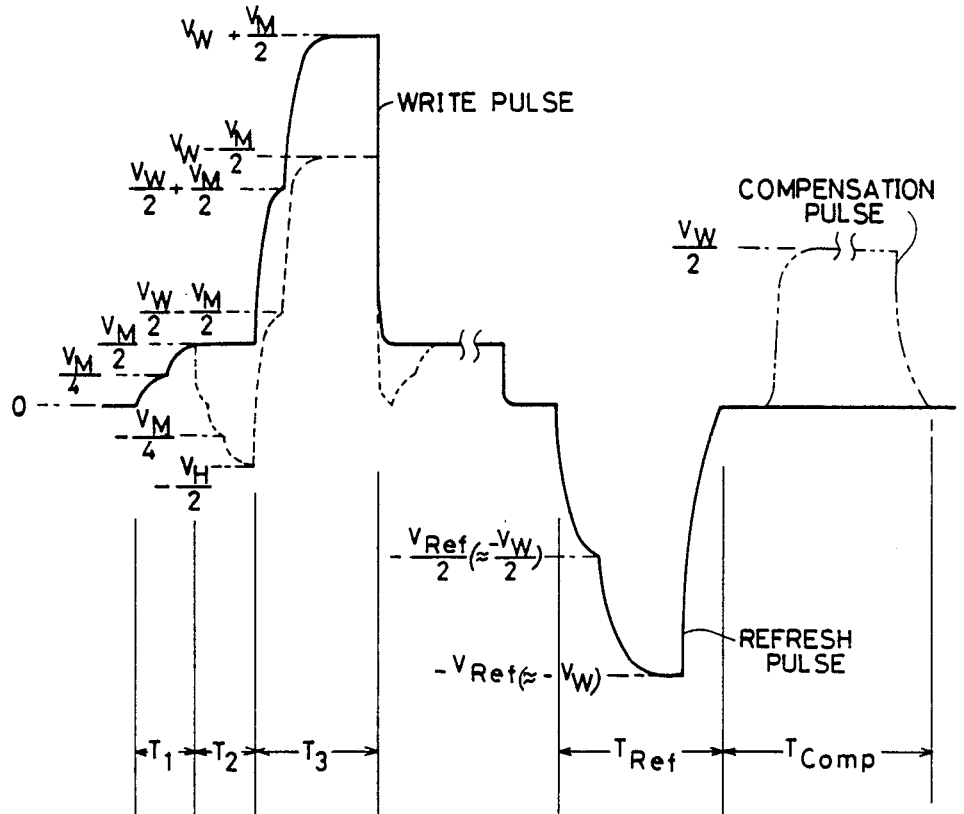
FIGS. 5(A) and 5(B) are waveform charts for explaining an operational mode of the EL panel drive system of FIGS. 3 and 4.
Figure 5B:
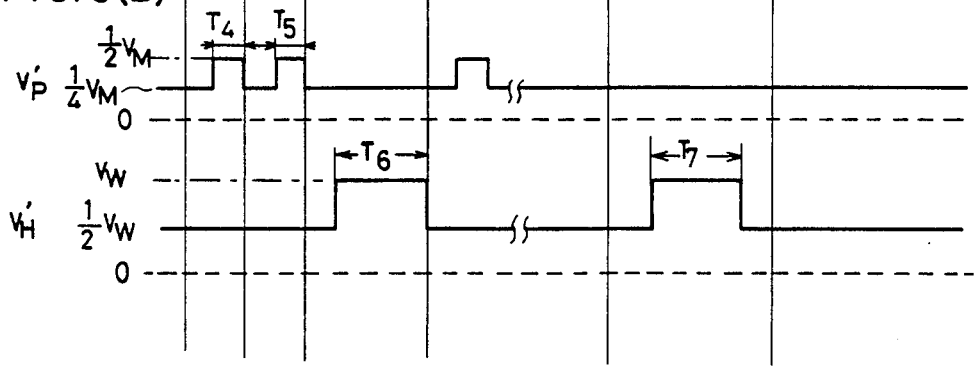
Figure 6:
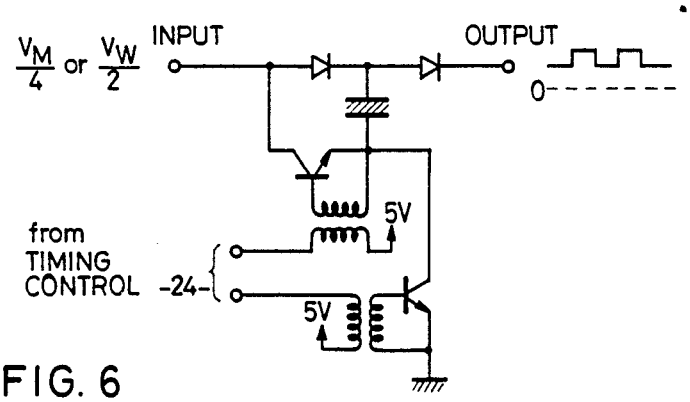
FIG. 6 is a circuit diagram of a voltage doubler circuit included in the EL panel drive systems of FIGS. 3 and 4.

The logic circuit drive voltage $V_L$ is applied to the oscillator/frequency divider 22 and the timing control circuit 24 via the wiring 28. A $\frac{1}{4}V_M$ voltage is introduced from a power supply circuit to the drive system via a wiring 36. The thus introduced $\frac{1}{4}V_M$ voltage is applied to a first voltage doubler circuit 38 and a DC booster circuit 40. The first voltage doubler circuit 38 develops, in accordance with the control signal developed from the timing control circuit 24, a doubled voltage $\frac{1}{2}V_M$ at a period $T_4$ (the last half part of the precharge period $T_1$) (see FIGS. 5(A) and 5(B)) and at a period $T_5$ (the last half part of the charge/discharge period $T_2$) (see FIGS. 5(A) and 5(B)). The thus developed doubled voltage $\frac{1}{2}V_M$ is applied to the data side modulation voltage applying circuit 16 and the scanning side modulation voltage applying circuit 18 via a wiring 42. The construction of the voltage doubler circuit 38 is well known in the art. FIG. 6 shows an example of the first voltage doubler circuit 38.

Figure 7:
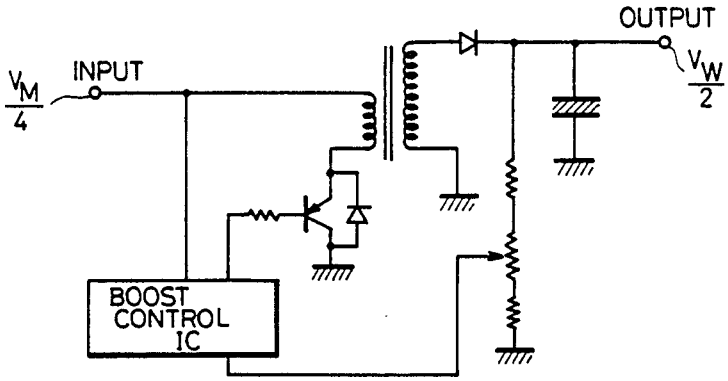
FIG. 7 is a circuit diagram of a DC booster circuit included in the EL panel drive systems of FIGS. 3 and 4.

The DC booster circuit 40 is a DC-DC converter which receives the $\frac{1}{4}V_M$ voltage and develops the $\frac{1}{2}V_W$ voltage. The construction of the DC booster circuit 40 is well known in the art. FIG. 7 shows an example of the DC booster circuit 40. The thus obtained $\frac{1}{2}V_W$ voltage is applied from the DC booster circuit 40 to a second voltage doubler circuit 44 via a wiring 46. The second voltage doubler circuit 44 develops, in accordance with the control signal developed from the timing control circuit 24, a doubled voltage $V_W$ (the write voltage $V_W$) at a period $T_6$ (the last part of the write period $T_3$) (see FIGS. 5(A) and 5(B) and a period $T_7$ (the middle part of the refresh period $T_{Ref}$) (see FIGS. 5(A) and 5(B)). The thus developed doubled voltage $V_W$ (the write voltage $V_W$) is applied to the write voltage ($V_W$)/refresh voltage ($V_{Ref}$) applying circuit 20 via a wiring 48. The construction of the second voltage doubler circuit 44 can be similar to that of the first voltage doubler circuit 38. FIG. 6 shows an example of the second voltage doubler circuit 44. In FIG. 5(A), the solid line represents the waveform of the voltage applied to the selected picture point, and the broken line represents the waveform of the voltage applied to the non-selected picture point. In a preferred form, the $\frac{1}{4}V_M$ voltage has the voltage level of about 15 (fifteen) volts.

It will be clear from FIG. 5(A) that the present drive system is suited for conducting the stepped drive method which minimizes the power consumption. More specifically, the voltage applied to the thin-film EL matrix display panel 14 increases from $\frac{1}{4}V_M$ to $\frac{1}{2}V_M$ within the precharge period $T_1$, from $-\frac{1}{4}V_M$ to $-\frac{1}{2}V_M$ within the charge/discharge period $T_2$, from ($\frac{1}{2}V_W+\frac{1}{2}V_M$) to ($V_W+\frac{1}{2}V_M$) or from ($\frac{1}{2}V_W-\frac{1}{2}V_M$) to ($V_W-\frac{1}{2}V_M$) within the write period $T_3$, and from $-\frac{1}{2}V_{Ref}$ to $-V_{Ref}$ within the refresh period $T_{Ref}$. An example of the stepped drive method is described in our copending application, "METHODS AND CIRCUITS FOR DRIVING THIN-FILM ELECTROLUMINESCENT DISPLAY PANELS", Ser. No. 412,377 filed on Aug. 27, 1982 now U.S. Pat. No. 4,594,589. (The British counterpart was published on Mar. 16, 1983 (Application No. 8224801 and the Publication No. 2,105,085); and the German counterpart is P 32 32 389.1 filed on Aug. 31, 1982.)

Figure 4:
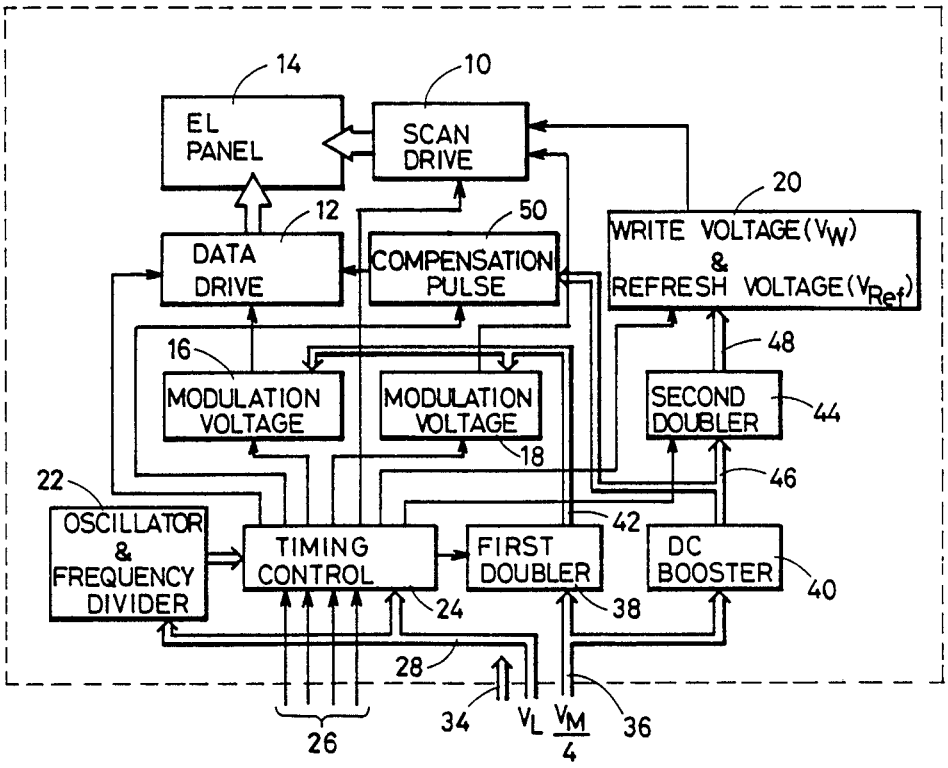
FIG. 4 is a block diagram of another embodiment of an EL panel drive system of the present invention.

FIG. 4 shows another embodiment of a thin-film EL matrix display panel drive system of the present invention. Like elements corresponding to those of FIG. 3 are indicated by like numerals.

The drive system of FIG. 4 additionally includes a compensation pulse applying circuit 50 which receives the $\frac{1}{2}V_W$ voltage from the DC booster circuit 40 and develops, in response to the control signal developed from the timing control circuit 24, a compensation pulse which has the voltage level equal to the $\frac{1}{2}V_W$ voltage. The compensation pulse developed from the compensation pulse applying circuit 50 is applied to the thin-film EL matrix display panel 14 through the data side driver circuit 12. The compensation pulse is shown by a chain line in FIG. 5(A). The compensation pulse is applied to the panel within a compensation period T Comp in order to minimize the image retention on the thin-film EL matrix display panel 14, thereby improving the display quality. An example of a circuit for minimizing the image retention is described in U.S. Pat. No. 4,479,120 entitled "METHOD FOR DRIVING A THIN-FILM EL PANEL", by Toshihiro OHBA, Masashi KAWAGUCHI, Hiroshi KINOSHITA, Yoshiharu KANATANI and Hisashi UEDE, and assigned to the same assignee as the present application. The compensation pulse is applied to the entire picture points of the thin-film EL matrix display panel 14 after the application of the refresh pulse. The compensation pulse has the voltage level which does not provide the luminescence on the thin-film EL matrix display panel 14, and has the opposite polarity to the refresh pulse.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A drive system for a thin-film EL display panel having a plurality of display lines comprising:

write voltage applying means for applying write voltage pulses to said thin-film EL display panel;

refresh voltage applying means for applying refresh voltage pulses to said thin-film EL panel;

compensation pulse voltage supplying means for supplying a compensation voltage pulse to said EL display panel to compensate for the difference in amplitude of polarized charges due to the difference in phase relationship at each display line between said refresh voltage pulses and said write voltage pulses;

modulation voltage applying means for applying a modulation voltage to said thin-film EL display panel;

timing control means, operatively connected to said write voltage applying means and said modulation voltage applying means, for developing control signals for controlling application of said write voltage and modulation voltage to said display panel;

a power supply terminal receiving a $\frac{1}{4}$ $V_M$ voltage from a power supply circuit, where said $\frac{1}{4}$ $V_M$ voltage has a $\frac{1}{4}$ voltage level of said modulation voltage;

a first voltage doubler circuit connected to said power supply terminal to receive said $\frac{1}{4}$ $V_M$ voltage at its input and developing a doubled voltage $\frac{1}{2}$ $V_M$ at its output in response to said control signals developed from said timing control means;

first means for applying said $\frac{1}{4}$ $V_M$ voltage supplied to said first voltage doubler and said doubled voltage $\frac{1}{2}$ $V_M$ developed from said first voltage doubler circuit to said modulation voltage applying means;

a DC booster circuit connected to said power supply terminal for developing $\frac{1}{2}$ $V_W$ voltage, where said $\frac{1}{2}$ $V_W$ voltage has a $\frac{1}{2}$ voltage level of said write voltage;

a second voltage doubler circuit connected to said DC booster circuit to receive said $\frac{1}{2}$ $V_W$ voltage at its input and for developing a doubled voltage $V_W$ at its output in response to said control signals developed from said timing control circuit; and second wiring means for applying said $\frac{1}{2}$ $V_W$ voltage developed by said DC booster circuit and said doubled voltage $V_W$ developed from said second voltage doubler circuit to said write voltage applying means and said refresh voltage supplying means;

third wiring means for applying said $\frac{1}{2}$ $V_W$ voltage developed by said DC booster circuit to said compensation pulse voltage supplying means;

said $\frac{1}{4}$ $V_M$ voltage received by said power supply terminal being the sole power used to drive said display panel;

both the voltages supplied to the inputs of said first and second voltage doubler circuits and the voltages developed by said first and second voltage doubler circuits being utilized as drive voltages to drive said display panel.

2. The drive system of claim 1 wherein said DC booster circuit comprises a DC-DC converter including:

chopper means, operatively connected to said power supply terminal, for converting said $\frac{1}{4}$ $V_M$ voltage into an alternating voltage, a step-up transformer connected to said chopper means and increasing the voltage of said alternating voltage, and smoothing means, connected to said step-up transformer for converting said alternating current into said $\frac{1}{2}$ $V_M$ voltage.

3. A drive system for a thin-film EL matrix display panel having a plurality of display lines comprising:

a scanning side driver circuit connected to scanning electrodes included in said thin-film EL matrix display panel;

a data side driver circuit connected to data electrodes included in said thin-film EL matrix display panel;

write voltage applying means for applying a write voltage and a refresh voltage to said scanning side driver circuit;

compensation pulse voltage supplying means for supplying a compensation voltage pulse to said EL display panel to compensate for the difference in amplitude of oppositely polarized charges applied across said EL display panel by said write voltage applying means due to the difference in the phase relationship at each display line between said write voltage and said refresh voltage applied thereto;

data side modulation voltage applying means for applying a modulation voltage to said data side driver circuit;

scanning side modulation voltage applying means for applying the modulation voltage to said scanning side driver circuit;

a timing control circuit connected to said write voltage applying means, data side modulation means and scanning side modulation means and developing control signals for controlling the application of said write voltage and modulation voltage to said display panel;

a power supply terminal receiving a $\frac{1}{4}$ $V_M$ voltage from a power supply circuit, where said $\frac{1}{4}$ $V_M$ voltage has a $\frac{1}{4}$ voltage level of said modulation voltage;

a first voltage doubler circuit connected to said power supply terminal to receive said $\frac{1}{4}$ $V_M$ voltage at its input and developing a doubled voltage $\frac{1}{2}$ $V_M$ at its output in response to said control signals developed from said timing control circuit, the doubled voltage $\frac{1}{2}$ $V_M$ developed from said first voltage doubler circuit being applied to said data side modulation voltage applying means and to said scanning side modulation voltage applying means;

a DC booster circuit connected to said power supply terminal and developing a $\frac{1}{2}$ $V_W$ voltage, where said $\frac{1}{2}$ $V_W$ voltage has a $\frac{1}{2}$ voltage level of said write voltage, said DC booster circuit supplying said $\frac{1}{2}$ $V_W$ voltage to said compensation pulse voltage supplying means; and a second voltage doubler circuit connected to said DC booster circuit to receive said $\frac{1}{2}$ $V_W$ voltage at its input and developing a doubled voltage $V_W$ at its output in response to said control signals developed from said timing control circuit, the doubled voltage $V_W$ developed from said second voltage doubler circuit being applied to said write voltage applying means;

said $\frac{1}{4}$ $V_M$ voltage received by said power supply terminal being the sole power used to drive said display panel;

both the voltages supplied to the inputs of said first and second voltage doubler circuits and the voltages developed at the outputs of said first and second voltage doubler circuits being utilized as drive voltages to drive said display panel.

4. A drive system for a thin-film electroluminescent (EL) display panel comprising:

drive voltage supplying means for applying drive voltage pulses to said thin-film EL display panel to drive said panel in a desired manner to selectively luminesce portions thereof;

timing control means, operatively connected to said write voltage applying means, for developing timing signals for controlling application of said drive voltage pulses;

said drive voltage supplying means applying said drive voltage pulses to said display panel at various voltages at times controlled by said timing signals;

means for receiving a first voltage;

a voltage doubler, operatively connected to said means for receiving, doubling said first voltage under control of said timing signals to develop a doubled voltage;

said drive voltage supplying means receiving and utilizing said first voltage and said doubled voltage as ones of said various voltages.

5. The drive system of claim 4 wherein said drive voltage supplying means comprises write voltage applying means for applying a write voltage to said display panel;

said first voltage being one half the write voltage ($\frac{1}{2}$ $V_W$), said doubled voltage being the write voltage ($V_W$);

said drive voltage supplying means successively supplying said first voltage and said doubled voltage to said display panel to stepwise apply said write voltage as a drive voltage pulse.

6. The drive system of claim 4 wherein said drive voltage supplying means further comprises modulation voltage applying means for applying a modulation voltage to said display panel;

said first voltage being one quarter the modulation voltage ($V_M/4$), said doubled voltage being one half the modulation voltage ($V_M/2$);

said modulation voltage supplying means successively supplying said first voltage and said doubled voltage to said display panel to stepwise apply said modulation voltage to said display.

7. The drive system of claim 6 wherein said drive voltge supplying means further comprises write voltage applying means for applying a write voltage ($V_W$) to said display panel;

said drive system further comprising:

a D.C. booster circuit connected to said first voltage and boosting said first voltage to a second voltage, said second voltage being one half the write voltage ($\frac{1}{2}$ $V_W$);

a second voltage doubler, operatively connected to said write voltage supplying means and doubling said second voltage under control of said timing signals to develop a second doubled voltage;

said drive voltage supplying means successively supplying said second voltage and said second doubled voltage to said display panel as ones of said various voltages to stepwise apply said write voltage as a drive voltage pulse.

8. The drive system of claim 7 wherein said DC booster circuit comprises a DC-DC converter.

9. The drive system of claim 7 wherein said drive voltage supplying means further comprises refresh voltage applying means for applying a refresh voltage pulse to said display panel as a said drive voltage pulse, said refresh voltage applying means receiving said second doubled voltage developed by said second voltage doubler.

10. The drive system of claim 9 wherein said drive voltage supplying means further comprises compensation pulse applying means for applying a compensation voltage pulse to said display panel as a said drive voltage pulse, said compensation voltage applying means receiving said second voltage from said DC booster circuit.

* * * * *